US011594092B2

(12) United States Patent
Valder et al.

(10) Patent No.: US 11,594,092 B2
(45) **Date of Patent: *Feb. 28, 2023**

(54) MULTI-SITE BUILDING ACCESS USING MOBILE CREDENTIALS

(71) Applicant: Honeywell International Inc., Charlotte, NC (US)

(72) Inventors: Roshan Valder, Bengaluru (IN); Murugan Gopalan, Bangalore (IN); Jayalaxmi Telang, Bangalore (IN); Aditya Arun, Bengaluru (IN); Sathish Kumar Vedachalam, Bengaluru (IN); Sanjay Roy, Plymouth, MN (US)

(73) Assignee: HONEYWELL INTERNATIONAL INC., Charlotte, NC (US)

( * ) Notice: Subject to any disclaimer, the term of this patent is extended or adjusted under 35 U.S.C. 154(b) by 0 days.

This patent is subject to a terminal disclaimer.

(21) Appl. No.: 17/343,690

(22) Filed: Jun. 9, 2021

(65) Prior Publication Data

US 2021/0304542 A1 Sep. 30, 2021

Related U.S. Application Data

(63) Continuation of application No. 16/372,653, filed on Apr. 2, 2019, now Pat. No. 11,055,943.

(51) Int. Cl.
*G07C 9/23* (2020.01)

(52) U.S. Cl.
CPC ..... *G07C 9/23* (2020.01)

(58) Field of Classification Search
CPC ..... G07C 9/21; G07C 9/23; G07C 9/29
See application file for complete search history.

(56) References Cited

U.S. PATENT DOCUMENTS

| | | | |
|---|---|---|---|
| 6,233,588 | B1 | 5/2001 | Marchoili et al. |
| 9,589,403 | B2 | 3/2017 | Lingan et al. |
| 9,666,000 | B1 | 5/2017 | Schoenfelder et al. |
| 9,697,656 | B2 | 7/2017 | Trani |

(Continued)

OTHER PUBLICATIONS

"HID Global Collaborates with Honeywell Building Solutions to Create New Mobile Access Experience for Occupants Within Buildings," HID Global, 7 pages, Nov. 15, 2016.

(Continued)

*Primary Examiner* — Qutbuddin Ghulamali
(74) *Attorney, Agent, or Firm* — Seager, Tufte & Wickhem, LLP

(57) ABSTRACT

Methods and systems for managing facility access credentials for two or more facilities are disclosed. The method may include electronically receiving a user request to gain access to a designated facility of the two or more facilities and electronically receiving user information related to a user that is making the user request. A facility access credential from a group of facility access credentials that are assigned by a third-party credential issuer may be obtained and linked to the user information and the designated facility. The obtained facility access credential for use in gaining access to the designated facility may be activated resulting in an activated facility access credential and a notification transmitted to the user notifying the user of the activated facility access credential.

20 Claims, 5 Drawing Sheets

(56) References Cited

U.S. PATENT DOCUMENTS

| | | | | |
|---|---|---|---|---|
| 9,713,002 | B2 | 7/2017 | Roy et al. | |
| 9,730,065 | B1 | 8/2017 | Chen | |
| 10,045,209 | B1 | 8/2018 | Ziraknejad | |
| 10,062,226 | B2 | 8/2018 | Kuenzi et al. | |
| 10,163,285 | B2 | 12/2018 | Schoenfelder et al. | |
| 10,565,531 | B1 * | 2/2020 | Heller | G07C 9/00896 |
| 2009/0132813 | A1 * | 5/2009 | Schibuk | G06Q 20/4014 726/9 |
| 2010/0306549 | A1 * | 12/2010 | Ullmann | G07C 9/27 713/185 |
| 2012/0310852 | A1 | 12/2012 | Ramalingamoorthy et al. | |
| 2015/0058950 | A1 | 2/2015 | Miu | |
| 2015/0279132 | A1 | 10/2015 | Perotti | |
| 2015/0281239 | A1 * | 10/2015 | Brophy | H04L 63/08 726/4 |
| 2016/0301689 | A1 | 10/2016 | Roy et al. | |
| 2016/0335819 | A1 * | 11/2016 | Lingan | G07C 9/28 |
| 2016/0353239 | A1 | 12/2016 | Kjellsson et al. | |
| 2017/0195336 | A1 | 7/2017 | Ouellette | |
| 2017/0345237 | A1 | 11/2017 | Kuenzi et al. | |
| 2018/0068503 | A1 | 3/2018 | Prasad et al. | |
| 2018/0151007 | A1 | 5/2018 | Einberg et al. | |
| 2018/0309741 | A1 | 10/2018 | Neafsey et al. | |

OTHER PUBLICATIONS

"Connect People to Your Building," Honeywell, 3 pages, 2019.
"Mobile Software Application Opens Doors to Deeper Facility Security," Honeywell, 2 pages, 2018.

* cited by examiner

200

202

Mobile Access Card Setup

Add details for Mobile/Digital access Credentials

206

ADD A DIGITAL CREDENTIAL

| | NAME | STATUS | CARDS REMAINING | LAST MODIFIED | ACTION |
|---|---|---|---|---|---|
| 208 | Card type S1<br>Master Credential | ● Default | 21 / 250 (207) | Jun21, 10:30AM | ACTION |
| 210 | Card type S2<br>Shared With Me | ● Active | 1 / 250 | Jun21, 10:30AM | ACTION |
| 212 | Card type S3 | ○ Inactive | 21 / 250 | Jun21, 10:30AM | ACTION |

204

Physical Access System (PACS) Setup

Credentials to connect to your PACS

GENERATE CREDENTIALS FOR PACS

| PACS SYSTEM NAME | CONNECTIVITY | EXPIRY | ACTION |
|---|---|---|---|
| Card Management System - Parking | ● Active | Jun21, 10:30AM | ACTION |
| Card Management System - Gnd Floor | ● Active | Jun21, 10:30AM | ACTION |

User Device Security

Phone Unlock Timeout

Changed last Mon 11:39 AM

FIG. 3

MULTI-SITE BUILDING ACCESS USING MOBILE CREDENTIALS

This application is a continuation of U.S. patent application Ser. No. 16/372,653, filed Apr. 2, 2019, entitled MULTI-SITE BUILDING ACCESS USING MOBILE CREDENTIALS, which is incorporated herein by reference.

TECHNICAL FIELD

The disclosure is directed to providing building access with mobile credentials. More particularly, the disclosure is directed to providing access to multiple building sites with mobile credentials.

BACKGROUND

Physical access control systems are designed to provide access to buildings and/or specific areas of a building for individuals who are authorized to access such areas, and deny access to buildings and/or specific areas of the building to individuals who are not authorized to access such areas. For example, certain individuals may be authorized to access a secure area of a building, whereas other individuals may not be allowed to access the secure area. In another example, certain individuals may be authorized to access a first building but not a second building, whereas other individuals may not be allowed to access both buildings. Also, access may be granted only during certain times.

Current approaches to physical access control systems often rely on users (e.g., employees) carrying physical access cards (e.g., physical badge) to gain entry to areas of a building. For example, a user can swipe a physical access card at a security door to gain entry to an area of a building. However, buildings in different geographical areas may have different card credentials and connectivity to different access system providers. This may require a different physical badge for each location a person needs access. What would be desirable is a system that allows easier access to multiple building sites even when the building sites have different access system providers.

SUMMARY

This disclosure is directed to providing access to multiple building sites using mobile credentials, as well as methods and systems for creating and distributing such mobile credentials in a user friendly manner.

In one example, a mobile device is configured to receive a user credential from a user to verify the identity of the user, and also receive a selection of a designated facility from the user via a user interface of the mobile device. After receiving the user credential and the selection of the designed facility, the mobile device is configured to transmit to an administrator a request for access to the designated facility, wherein the request for access identifies the user, the designed facility and the administrator. In response to transmitting the request for access, and assuming the request is granted, the mobile device is configured to receive a facility access credential, wherein the facility access credential, when presented to a secured entry point of the designated facility, allows access to the designated facility.

In another example, a method for issuing facility access credentials to a user for each of multiple facilities of an organization includes storing a user profile of the user, receiving a user request for access to a designated facility, presenting the user request to an administrator and if the request for access is granted by the administrator, obtaining a facility access credential from a group of facility access credentials that are assigned to the organization by a third-party credential issuer, associating the obtained facility access credential with the user profile and the designated facility, transmitting the obtained facility credential to the user, storing the obtained facility credential in a mobile device of the user, and activating the obtained facility credential for use in gaining access to the designated facility.

In another example, a method managing facility access credentials for two or more facilities includes electronically receiving a user request to gain access to a designated facility of the two or more facilities and electronically receiving user information related to a user that is making the user request. If the request is granted, a facility access credential from a group of facility access credentials that are assigned by a third-party credential issuer is obtained and linked to the user information and the designated facility. The obtained facility access credential for use in gaining access to the designated facility may be activated resulting in an activated facility access credential and a notification transmitted to the user notifying the user of the activated facility access credential.

The preceding summary is provided to facilitate an understanding of some of the features of the present disclosure and is not intended to be a full description. A full appreciation of the disclosure can be gained by taking the entire specification, claims, drawings, and abstract as a whole.

BRIEF DESCRIPTION OF THE DRAWINGS

The disclosure may be more completely understood in consideration of the following detailed description of various embodiments in connection with the accompanying drawings, in which:

FIG. 3 is an illustrative mobile access card setup portal for use by an administrator;

Figure 1:
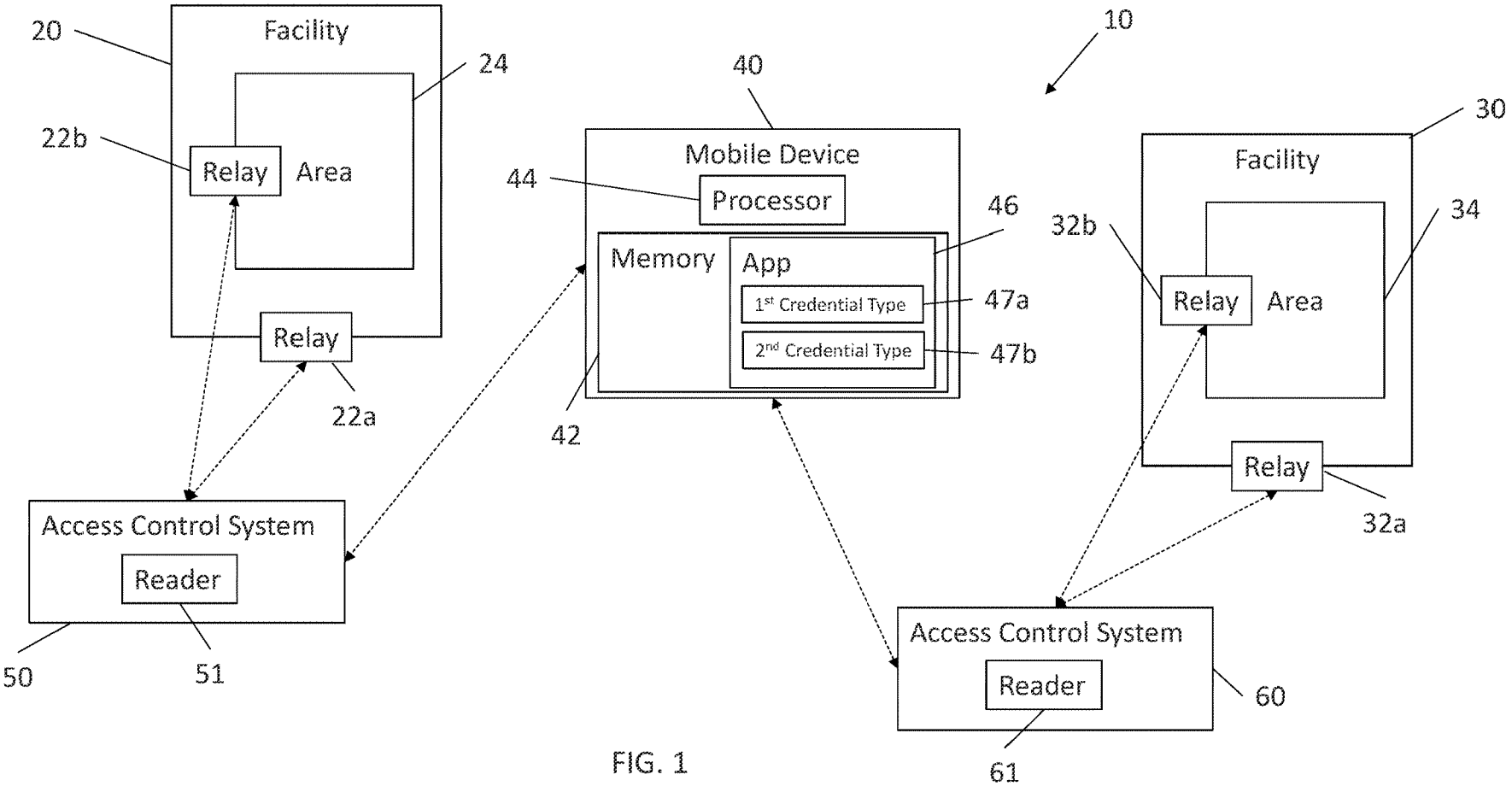
FIG. 1 is a schematic diagram of an illustrative access control system for multiple buildings via mobile device.

While the disclosure is amenable to various modifications and alternative forms, specifics thereof have been shown by way of example in the drawings and will be described in detail. It should be understood, however, that the intention is not to limit aspects of the disclosure to the particular embodiments described. On the contrary, the intention is to cover all modifications, equivalents, and alternatives falling within the spirit and scope of the disclosure.

DETAILED DESCRIPTION

For the following defined terms, these definitions shall be applied, unless a different definition is given in the claims or elsewhere in this specification.

All numeric values are herein assumed to be modified by the term "about", whether or not explicitly indicated. The term "about" generally refers to a range of numbers that one of skill in the art would consider equivalent to the recited value (i.e., having the same function or result). In many instances, the term "about" may be indicative as including numbers that are rounded to the nearest significant figure.

The recitation of numerical ranges by endpoints includes all numbers within that range (e.g., 1 to 5 includes 1, 1.5, 2, 2.75, 3, 3.80, 4, and 5).

Although some suitable dimensions ranges and/or values pertaining to various components, features and/or specifications are disclosed, one of skill in the art, incited by the present disclosure, would understand desired dimensions, ranges and/or values may deviate from those expressly disclosed.

As used in this specification and the appended claims, the singular forms "a", "an", and "the" include plural referents unless the content clearly dictates otherwise. As used in this specification and the appended claims, the term "or" is generally employed in its sense including "and/or" unless the content clearly dictates otherwise.

The following detailed description should be read with reference to the drawings in which similar elements in different drawings are numbered the same. The drawings show by way of illustration how one or more embodiments of the disclosure may be practiced.

These embodiments are described in sufficient detail to enable those of ordinary skill in the art to practice one or more embodiments of this disclosure. It is to be understood that other embodiments may be utilized and that process, electrical, and/or structural changes may be made without departing from the scope of the present disclosure.

The detailed description and the drawings, which are not necessarily to scale, depict illustrative embodiments and are not intended to limit the scope of the disclosure. The illustrative embodiments depicted are intended only as exemplary. Selected features of any illustrative embodiment may be incorporated into an additional embodiment unless clearly stated to the contrary.

Generally speaking, increased security can be provided through capabilities offered by mobile devices. In some embodiments, biometric validation (e.g., fingerprint scanning) can be carried out via the mobile device. In some embodiments, users (i.e., the user's mobile device) can be assigned a digital identifier (discussed in more detail herein). The digital identifier can allow the mobile device, instead of a physical hardware access controller, to be used to gain access to a secure area or facility.

User interaction with a door access control system can be streamlined via capabilities offered by mobile devices. For example, in some embodiments, global positioning system (GPS), WiFi, Bluetooth and/or other location functionalities provided by the mobile device may allow the automatic determination of user location (e.g., without user input). Thus, in some cases, rather than physically presenting a card (or other device) for access to an area or facility, the user may simply move within a particular distance of the access control device. That is, whereas previous approaches often utilize "card readers," which typically call for a user to present a particular card (e.g., badge and/or other token), read the card, then transmit a signal to an access controller to make an access determination (e.g., whether the user is allowed access), embodiments of the present disclosure can allow the mobile device itself to effectively become the access card. Then, the "card" can be presented to a "reader" by virtue of the mobile device being in a particular physical location (or within a particular distance of a particular physical location).

The present disclosure is generally directed towards a method and system for allowing secure access to multiple buildings (e.g., two or more) in different geographical locations. It is contemplated that the system may allow a user to access two different buildings having two different access system providers using the same mobile device. In some cases, the buildings may belong to the same entity (e.g., company and corporation) or the buildings may belong to different entities, as may be the case for a person servicing certain building equipment that is use in many buildings.

In one example, a mobile device may be configured to provide a specific user identity, assigned to the mobile device, and a digital identifier, that is associated with an application stored in memory on the mobile device, to a door access controller. The mobile device may be configured to provide different digital identifiers to different access systems to allow entry into different buildings, as will be described in more detail herein.

Embodiments of the present disclosure can reduce the need to issue a physical badge for every location or facility a person (e.g., an employee, a contractor, a repair person, etc.) needs to access. Further, embodiments of the present disclosure may streamline or facilitate access requests for access to additional facilities and/or locations.

FIG. 1 is a schematic diagram of an illustrative access control system 10 for multiple buildings 20, 30 via mobile device 40. A facility or building, as used herein, can refer to one or more buildings, businesses, homes, plants, hospitals, refineries, etc. Facilities can include indoor and/or outdoor areas. The illustrative system 10 may include a first facility 20, a second facility 30, a mobile device 40, a first door access control system (ACS) 50 including at least one card reader 51 and in communication with one or more relays 22*a*, 22*b* (collectively 22), and a second door access control system (ACS) 60 including at least one card reader 61 and in communication with one or more relays 32*a*, 32*b* (collectively, 32). While the illustrative system 10 includes a first and a second facility 20, 30, it should be understood that the system 10 may be applied to more than two facilities, such as, but not limited to three or more, 10 or more, 20 or more, 50 or more, etc. Similarly, while the illustrative system 10 is illustrated as having a first and a second access system 50, 60, it should be understood that the system 10 may be applied to more than two access systems, such as, but not limited to three or more, 10 or more, 20 or more, 50 or more, etc. For example, in some cases, the number of access systems may correspond to the number of facilities in the system 10. Further, while the access control systems 50, 60 are described as door access control systems, the access control systems 50, 60 may control other means of entry into a building, including, but not limited to, turnstiles or baffle gates, revolving doors, gates, etc.

Though in the example illustrated in FIG. 1 the first ACS 50 is shown external to the first facility 20 (e.g., remote with respect to the first facility 20) and the second ACS 60 is shown external to the second facility 30 (e.g., remote with respect to the second facility 30), embodiments of the present disclosure are not so limited. In some cases, the first ACS 50 and/or the second ACS 60 are internal to the first facility 20 (e.g., local with respect to the first facility 20) and/or the second facility 30 (e.g., local with respect to the second facility 30), respectively.

The mobile device 40 may be a client device carried or worn by a user. For example, the mobile device 40 may be a phone (e.g., smartphone), personal digital assistant (PDA), tablet, and/or wearable device (e.g., wristband, watch, necklace, etc.). These are just examples. The mobile device 40 can include one or more software applications (e.g., apps) 46 stored within a memory 42 of the mobile device 40 that can define and/or control communications between the mobile device, the first ACS 50, the second ACS 60, and/or other devices. Apps 46 may be received by the mobile device 40 from the first ACS 50 and/or the second ACS 60, for instance, although this is not required. In other embodiments, the application 46 may be downloaded from an app store, such as, but not limited to ITUNES® or GOOGLE PLAY®.

Apps 46 may be launched by a user and/or responsive to some other condition (e.g., the interaction between the mobile device 40 and a device within the door access system, such as a controller or relay). In some embodiments, apps 46 can be executing as background apps. As used herein, at least one of the apps 46 includes a digital identifier, discussed further below. In some cases, at least one of the apps 46 may include more than one digital identifier. The more than one digital identifier may be of different credential types, discussed further below. For example, at least one of the apps 46 may include a first digital identifier having a first credential type 47*a* and a second digital identifier having a second credential type 47*b* to allow access into different buildings or areas of buildings. Fewer than two or more than two digital identifiers and/or credential types 47*a*, 47*b* may be used, as desire.

The relays 22, 32 can be actuated by variation in conditions of one or more electric circuits. In some examples, the relays 22, 32 can be a locking device (e.g., for a door). In some examples, the relays 22, 32 can include one or more actuating mechanisms. The relays 22, 32 can be associated with one or more controlled functionalities. As used herein "controlled functionality" refers to a functionality under the control of the first ACS 50 and/or the second ACS 60. For instance, an electronic door lock may include a relay that is controlled by the first ACS 50 and/or the second ACS 60 to lock/unlock a door.

The relays 22*a*, 32*a* can be associated with an entry point (e.g., an exterior door) of the respective facility 20, 30, and/or the relays 22*b*, 32*b* can be associated with a specific area 24, 34 of the respective facility 20, 30. As referred to herein, an area can be a portion of a facility. In some embodiments, the area 24, 34 can be a room, a plurality of rooms, a wing, a building, a plurality of buildings, an campus, etc. In some embodiments, the area 24, 34 can be defined by physical boundaries (e.g., walls, doors, etc.). In some embodiments, the area 24, 34 can be defined by logical and/or geographic boundaries. The area 24, 34 can be defined by a user, by a Building Information Model (BIM) associated with the respective facility 20, 30, and/or by the first ACS 50 and/or the second ACS 60.

The first ACS 50 and/or the second ACS 60 can control (e.g., manage) access to a number of areas (e.g., the area 24, 34) of the respective facility 20, 30. As previously discussed, the first ACS 50 and/or the second ACS 60 can be remote with respect to the facility 20, 30 and/or local with respect to the facility 20, 30. In some embodiments, the first ACS 50 and/or the second ACS 60 can be cloud-based. In some embodiments, the first ACS 50 and/or the second ACS 60 can manage access to one or more areas across a plurality of facilities. It is further contemplated that the first ACS 50 and the second ACS 60 may be configured to accept different credentials and/or may have different connectivity, although this is not required.

The mobile device 40 can communicate with (e.g., exchange data with) the first ACS 50 and/or the second ACS 60 via a wired and/or wireless connection, for instance. In some embodiments, the mobile device 40 can communicate using one or more communication modules (e.g., cellular, WiFi, etc.). The first ACS 50 and/or the second ACS 60 can communicate with the relays 22, 32 via a wired and/or wireless connection, for instance. Communication between various devices herein can be carried out over a wireless network. A wireless network, as used herein, can include WiFi, Bluetooth, Cellular or any other suitable means to wirelessly transmit and/or receive information.

The illustrative mobile device 40 includes a memory 42 and a processor 44. The processor 44 is configured to execute executable instructions stored in the memory 42 to perform various tasks. Data may also be stored in the memory 42 to be used in executing the instructions. For example, in some embodiments, the memory 42 includes instructions executable by the processor 44 to provide data in the form of a specific user identity, assigned to the mobile device, to the door access controller. The memory 42 can be any type of non-transitory storage medium that can be accessed by the processor 44 to perform various examples of the present disclosure. For example, the memory 42 can be a non-transitory computer readable medium having computer readable instructions (e.g., computer program instructions) stored thereon that are executable by the processor 44. The execution of the computer readable instructions may result in the actuation of a relay 22, 32 which in turn allows entrance to a facility 20, 30 and/or an area 24, 34 of said facility 20, 30.

The memory 42 can be volatile or nonvolatile memory. The memory 42 can also be removable (e.g., portable) memory, or non-removable (e.g., internal) memory. For example, the memory 42 can be random access memory (RAM) (e.g., dynamic random access memory (DRAM) and/or phase change random access memory (PCRAM)), read-only memory (ROM) (e.g., electrically erasable programmable read-only memory (EEPROM) and/or compact-disc read-only memory (CD-ROM)), flash memory, a laser disc, a digital versatile disc (DVD) or other optical storage, and/or a magnetic medium such as magnetic cassettes, tapes, or disks, among other types of memory.

Further, although memory 42 is illustrated as being located within the mobile device 40, embodiments of the present disclosure are not so limited. For example, memory 42 can also be located internal to another computing resource (e.g., enabling computer readable instructions to be downloaded over the Internet or another wired or wireless connection). In some embodiments, the memory 42 and/or the processor 44 can be located in the first ACS 50 and/or the second ACS 60.

In addition to, or in place of, the execution of executable instructions, various examples of the present disclosure can be performed via one or more devices (e.g., one or more controllers) having logic. As used herein, "logic" is an alternative or additional processing resource to execute the actions and/or functions, etc., described herein, which is includes hardware (e.g., various forms of transistor logic, application specific integrated circuits (ASICs), etc.), as opposed to computer executable instructions (e.g., software, firmware, etc.) stored in memory and executable by a processor. It is presumed that logic similarly executes instructions for purposes of the embodiments of the present disclosure.

In some cases, the memory 42 can also include data in the form of a digital identifier that is associated with an application 46 that is also stored in memory 42 on the mobile device 40. The memory 42 can also include instructions executable by the processor 44 to provide this information to a door access controller when the application 46 is in use (e.g., the user has met certain conditions that enable the user to request that the digital identifier be sent to the door access controller). In some embodiments, the use of the application 46 will initiate the sending of the identifier automatically. In some cases, the user must authenticate himself to the mobile device by entering a password or fingerprint scan to unlock the mobile device 40 and/or application 46, before the application 46 will initiate the sending of the identifier.

Figure 2:
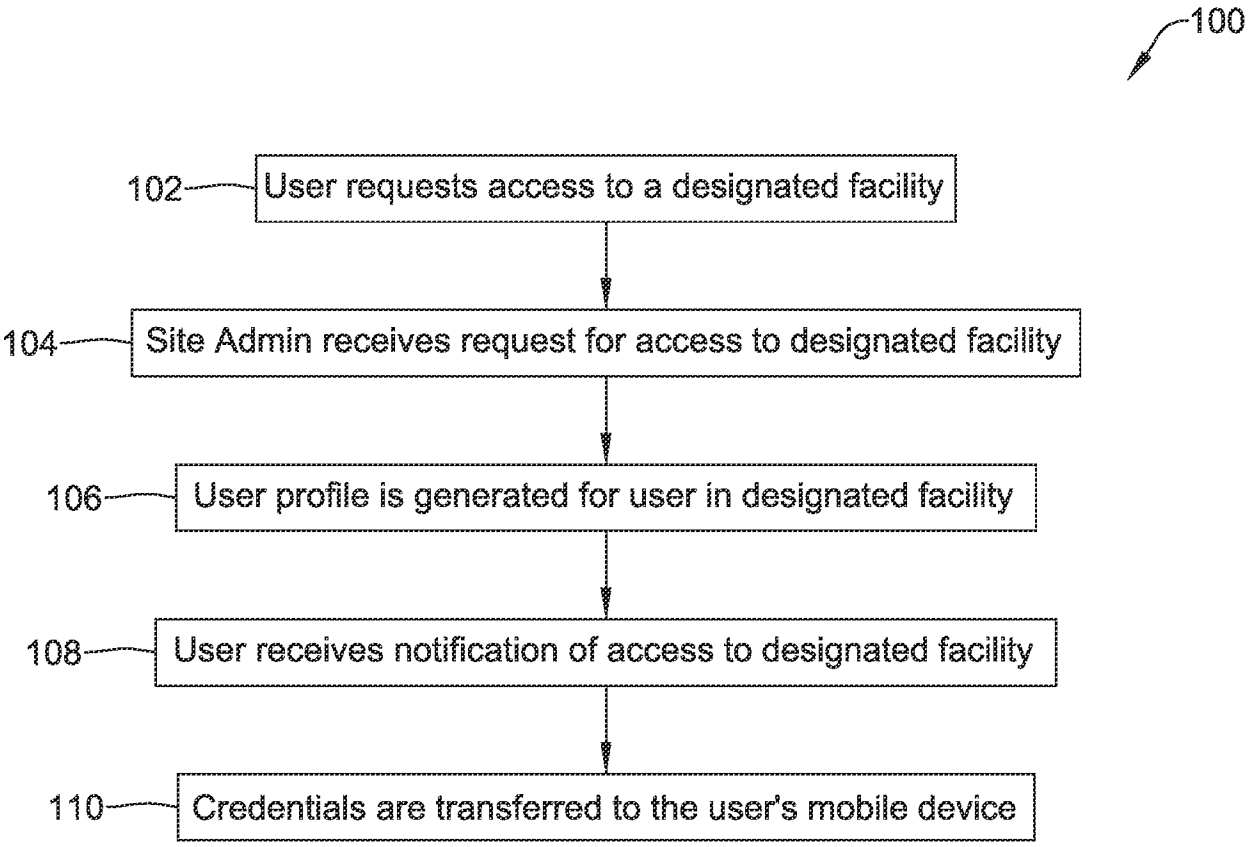
FIG. 2 is a flow chart of an illustrative method for allowing a person to gain entry to more than one facility using a mobile device.

FIG. 2 is a flow chart of an illustrative method 100 for allowing a person to gain entry to more than one facility using a mobile device. To begin, a person or user may request access to a facility, as shown at block 102. The facility to which access is being requested may be referred to as a designated facility. In some embodiments, the user may already have access to at least one facility (or area) using the mobile device 40 as entry credentials. The user may request access to a different or designated facility (e.g., a different facility may be one that the user does not currently have access to) by contacting a site administrator. For the sake of illustration, and not by way of limitation, in the present example, the user may have access to the first facility 20 and may be requesting access to the second facility 30.

The user may request access to the designated facility in a number of different ways. It is contemplated that the user is not limited to requesting access to a single facility. In some cases, the user may request access to a plurality of facilities in a single request. In some cases, the user may contact a site administrator that is local to the user (e.g., associated with the first facility 20 to which the user already has access) via telephone, e-mail, text message, or other electronic communication to request access to the designated facility (e.g., the second facility 30). In some cases, the local site administrator may then communicate the request to the site administrator of the designated facility. In other cases, the user may contact the site administrator of the designated facility directly. In some cases, the user may call, email, text message or otherwise electronically communicate with the site administrator of the designated facility.

In some cases, the user may request access via the application 46 on their mobile device 40. For example, the application 46, which is used to communicate with or provide credentials to the access control system(s) 50, 60 and/or the relays 22, 32, may also be used to request access to another facility or a designated facility. It is contemplated that the user may be required to provide a user credential (password, fingerprint scan, facial recognition, etc.) to the mobile device 40 to verify the identity of the user prior to the user accessing the application 46 and/or sending requests for access to a designated facility. The user credential may be a biometric credential (e.g., fingerprint, facial recognition, iris recognition, voice recognition, etc.), a user password, etc. With the application 46 opened, the user may select or actuate a user selectable button displayed on a display screen of the mobile device 40. In some cases, the user selectable button may be a selection of a designated facility. For example, the application 46 may be configured to display a plurality of available facilities that are available for selection by the user and to allow the user to select one or more designated facilities from the plurality of available facilities. In some cases, the application 46 may be configured to display a notification on the user interface of the mobile device prompting the user to confirm the designated facility. Upon receiving the selection of the designated facility, the mobile device 40 may be configured to transmit the request for access to a site administrator. The request for access may include, for example, the user identity, the designated facility and/or the administrator (e.g., one of or both of a local administrator or an administrator of the designated facility).

The site administrator at the designated facility may receive the request for access to the designated facility, as shown at block 104. It is contemplated that the site administrator (e.g., at the second facility 30) at the designated facility may receive the request from a local site administrator (e.g., at the first facility 20), directly from the user (e.g., via e-mail, verbal communication, or other communication), or via a request initiated within the application 46 by the user or on behalf of the user. In some cases, the request for access may be received as an email. In other embodiments, the request for access may be received via a credential management program or software. In some cases, the request for access may be received via an application running on the mobile device 40. In some embodiments, such an application may be the same application 46 as used for providing access credentials to an ACS 50, 60. While in other embodiments, the application may be a separate or different application from application 46. In yet other cases, the request for access may be received via a verbal communication. The request for access may be accompanied by the user identity, the name and/or location of the designated facility, the local site administrator, and/or the site administrator for the designated facility. This and/or other information may be included, such as, but not limited to, a reason why access is required, a length of time that access should be granted, etc.

Once the site administrator at the designated facility has received the access request, a user profile may be generated for the user, as shown at block 106. It is contemplated that in some instances, a user profile may already exist for the user within the organization. In such an instance, the existing user profile may be associated with facility access credentials for the designated facility in lieu of creating a new user profile. The user profile may be created and/or updated in a portal accessible by the site administrator of the designated facility. FIG. 3 shows an illustrative mobile access card setup portal 200 that may be used by a site administrator to create a user profile and link an access credential to said user profile. It is contemplated that the mobile access card setup portal 200 may be accessible via a network, such as, but not limited to a local area network (LAN) or a wide area network or global network (WAN), such as the internet. In some cases, the mobile access card setup portal 200 may be accessible via an external or remote server also referred to as "the cloud."

Figure 4:
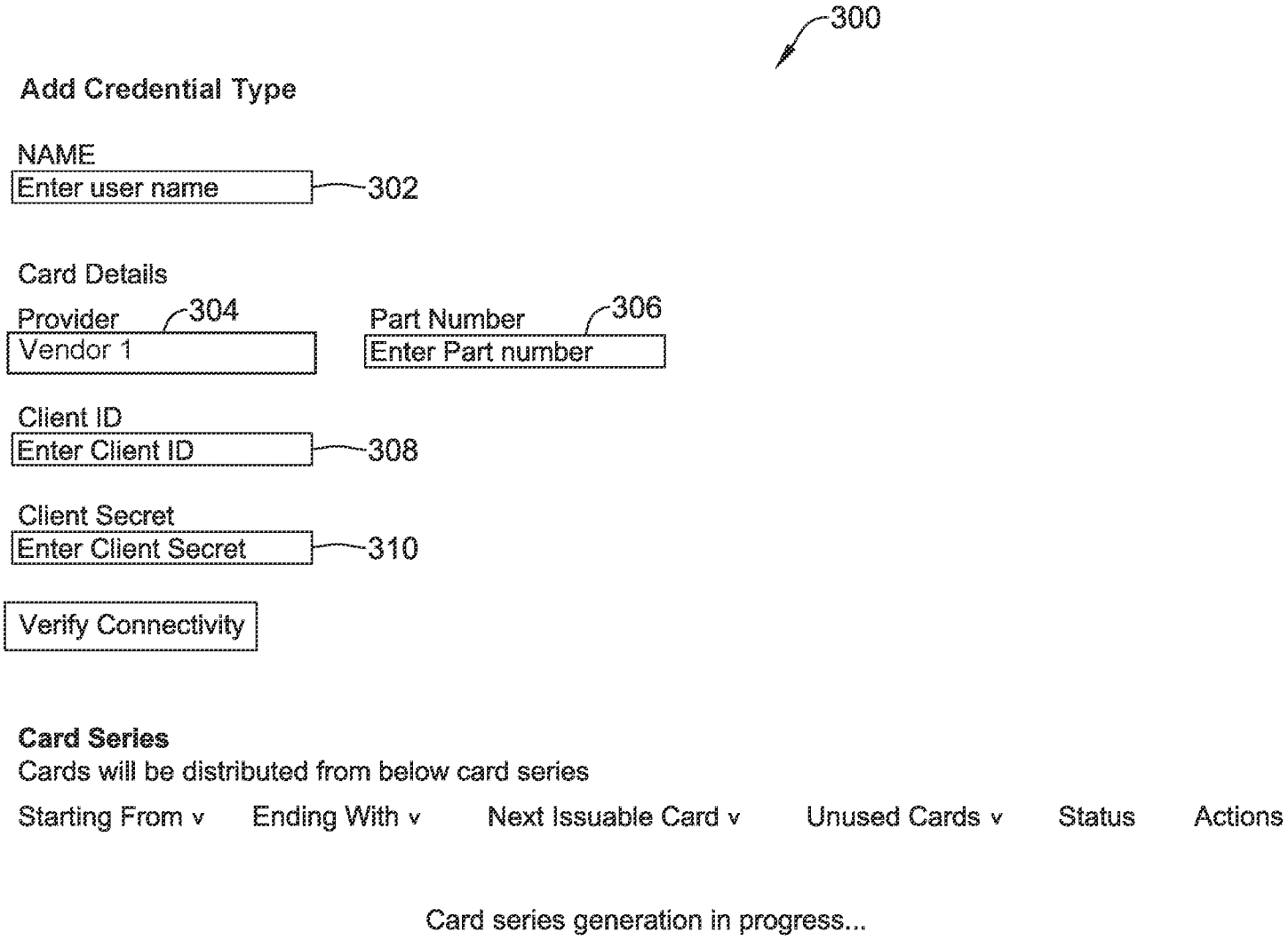
FIG. 4 is an illustrative digital credential creation portal for use by an administrator.

The portal 200 may allow the site administrator to manage mobile access cards (e.g., the use of mobile devices as an access card) via the mobile access card setup section 202 and/or manage the physical access system via the physical access system setup section 204. To add a user profile, the site administrator may select the "add a digital credential" option 206, or similar menu option. Upon selection of the "add a digital credential" option 206, the portal 200 may display an "add credential" page 300, an example of which is shown in FIG. 4. The "add credential" page 300 may connect the site administrator to the third party vendor's application programming interface (API). Here, the site administrator may enter the user's name 302. In some cases, the user's name may not be the user's actual name but rather may be an email address, an app log-in user name, etc. The site administrator may then assign a credential, which in some cases has been assigned to the organization by a third party credential issuer. The credential may identify the third party credential issuer at 304 and an associated serial number 306. In some cases, the credential may include a third party vendor identification 308 (e.g., client identification) and secret 310 (e.g., password) which may allow the portal 200, access control system 50, 60 and/or the app 46 to connect to the third party vendor cloud via the API. This may allow the credential to be retrieved, verified, etc. from the third party vendor. The site administrator may then verify the credential by selecting verify connectivity 312. The "add credential" page 300 may close and the site administrator may note that there is one less credential available in the pool of credentials shown at 207 in FIG. 3. The portal 200 may further allow the site administrator to edit credentials as necessary. In some cases, different card types may be associated with different access areas within a facility. For example, a first card type 208 may allow access into a facility (e.g., referring back to FIG. 1, activate a relay 32*a* to allow access into the second facility 30). The second card type 210 may allow access into a specific area 34 of the facility by activating a different relay 32*b*. It is contemplated that a user may use a same mobile device 40 and a same application 46 to access both the facility 30 and the specific area 34 of the facility if access is so granted. In some instances, a third type of card 212 may also be available. It is contemplated that each facility 20, 30 may have more than three or fewer than three types of cards or credentials, as desired.

As described above, the credential assigned to a particular user may be selected from a pool of third party supplied credentials. In some cases, the pool of credentials may be specific to the designated facility. In other embodiments, a parent organization may share credentials across their facilities.

Returning to FIG. 2, when the site administrator adds the user into the portal for the designated site, the user may receive a notification, as shown at block 108. The type of notification may vary. If the user does not have the specific application 46 for managing and utilizing mobile credentials, the user may receive a welcome e-mail from the first organization (e.g., facility) to which the user is added. The e-mail may include information for obtaining the application 46, a user identification (ID), facility information (e.g., where the credentials are valid) and/or instructions for using mobile credentials. Once the user has downloaded the application 46, the credentials may be transferred to or received at the user's mobile device 40 (e.g., into the application 46 and/or memory 42) in the form of a virtual card or badge, as shown at block 110. The facility access credential may be stored in the mobile device 40 (e.g., in the memory 42). When the mobile device 40 is presented to a secured entry point of the designated facility, access may then be allowed to the designated facility via the secured entry point. It is contemplated that the application 46 does not necessarily need to be open or actively in use to communicate the facility access credential to the access control system of the facility. For example, once the facility access credential is received and stored at the mobile device 40, the facility access credential may be activated and usable for gaining access to the corresponding facility whether the application 46 is actively in use or not.

If the user is currently using or has previously used the application 46 for mobile credentials, when the user is added to a second and/or a new organization, the user may be notified via email that access has been granted to the designated facility. Additionally, or alternatively, the user may receive a notification at their mobile device 40 (e.g., via the application 46) indicating that mobile credentials are available to be used at the designated facility. For example, the application 46 may be configured to display on a user interface of the mobile device a notification when new credentials are available. It is further contemplated that once the application 46 is launched, the user may receive an addition notification that their accessible locations (facilities) has been updated. The credentials may be transferred to or received at the user's mobile device 40 (e.g., into the application 46 and/or memory 42) in the form of a virtual card or badge, as shown at block 110, without user intervention when the app is already installed on the user's mobile device. The facility access credential may be stored in the mobile device 40 (e.g., in the memory 42). When the mobile device 40 is presented to a secured entry point of the designated facility, access may be allowed to the designated facility via the secured entry point. It is contemplated that the application 46 does not necessarily need to be open or actively in use to communicate the facility access credential to the access control system of the facility. For example, once the facility access credential is received and stored at the mobile device 40, the facility access credential may activated and usable for gaining access to the corresponding facility whether the application 46 is actively in use or not.

In some cases, the user may manually switch between locations by selecting a facility to be accessed from a list of accessible facilities viewable on the display of the mobile device. For example, the application 46 may be configured to the display on the mobile device a plurality of available facilities that are available for selection by the user such that the user may select a designated facility to which access is desired. Once the user has selected the designated the facility, the app may be configured to display a notification on the user interface of the mobile device prompting the user to confirm the facility access credential. Upon selection of the particular facility, the application 46 may present the corresponding facility access credential to the secure entry point of the designated facility. In other instances, the application 46 may be configured use a location service of the mobile device 40 to automatically select a particular one of the available facilities that is located closest to the mobile device 40, and in response present the corresponding facility access credential to the secured entry point of the selected designated facility. The available facilities may be any facility for which the user has a profile and a credential. In some cases, the application 46 may be configured to display on a user interface of the mobile device both the facilities to the which the user currently has access and a listing of designated facilities to which the user has requested access.

Figure 5:
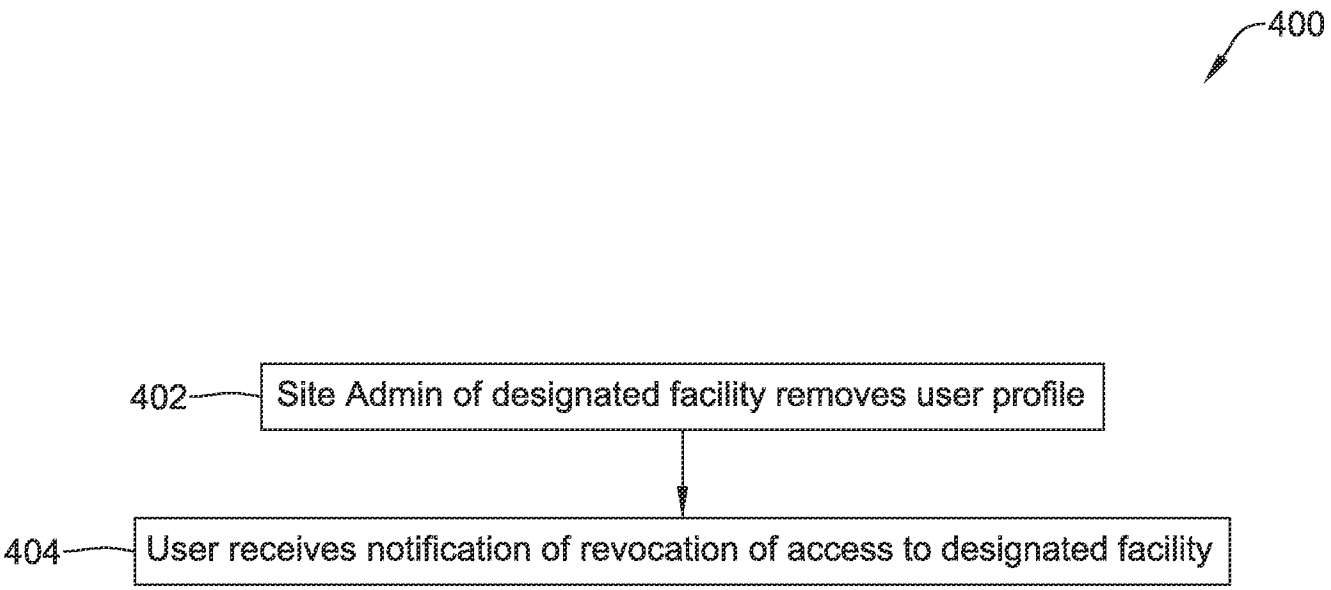
FIG. 5 is flow chart of an illustrative method for revoking a person's access to a facility.

In some embodiments, the facility access credentials for a user at a particular facility may be revoked. FIG. 5 shows a flow chart of an illustrative method 400 for revoking a user's facility access credentials for a designated facility. When a user's access is no longer needed and/or allowed to a designated facility, the site administrator may remove the user's profile from the mobile access card setup portal, as shown at block 402. In some cases, the credentials may be revoked because the user only required temporary access to the designated facility. It is contemplated that the site administrator may enter a predetermined credential expiration date (e.g., the facility access credential is available for a predetermined length of time) into the user's profile when the request is known to be temporary. It is contemplated that at the credential expiration date (e.g., the expiration of the predetermined length of time), the facility access credential may be automatically revoked (e.g., without intervention by the site administrator). Upon deletion of the user profile from the designated facility's credential management system, a notification may be sent to the user notifying the user that they have been removed from a location, as shown at block 404.

The user may be notified via email that access has been revoked or is no longer available to the designated facility. Additionally, or alternatively, the user may receive a notification at their mobile device 40 (e.g., via the application) informing said user that that the facility access credential is no longer available to be used or has been revoked at the designated facility. For example, the application 46 may be configured to display on a user interface of the mobile device a notification when credentials are no longer available. It is further contemplated that once the application 46 is launched, the user may receive an addition notification that their accessible locations (facilities) has been updated.

Those skilled in the art will recognize that the present disclosure may be manifested in a variety of forms other than the specific embodiments described and contemplated herein. Accordingly, departure in form and detail may be made without departing from the scope and spirit of the present disclosure as described in the appended claims.

What is claimed is:

1. A non-transitory computer-readable medium having instructions stored thereon that when executed by a mobile device cause the mobile device to:

receive and store at the mobile device a plurality of facility access credentials, wherein the plurality of facility access credentials corresponds to a plurality of facilities to which a user has requested and currently has access;

display on a user interface of the mobile device an identifier for each of the plurality of facilities to which the user has requested and currently has access; and receive a selection of a particular one of the plurality of facilities to which the user has requested and currently has access, and in response, present the corresponding facility access credential to a secured entry point of the selected facility to grant physical access of the user to the selected facility.

2. The non-transitory computer-readable medium of claim 1, wherein the instructions when executed by the mobile device cause the mobile device to receive the selection of the particular one of the plurality of facilities to which the user has requested and currently has access by receiving a selection via the user interface of the mobile device of the identifier that correspond to the selected facility.

3. The non-transitory computer-readable medium of claim 1, wherein the identifier for each of the plurality of facilities comprises a selectable element in a listing of the plurality of facilities to which the user has requested and currently has access.

4. The non-transitory computer-readable medium of claim 1, wherein the instructions are part of an application program that is downloaded and installed on the mobile device.

5. The non-transitory computer-readable medium of claim 1, wherein the instructions when executed by the mobile device are configured to receive the selection of the particular one of the plurality of facilities from a location service of the mobile device, wherein the selected facility of the plurality of facilities is currently closest to the mobile device.

6. The non-transitory computer-readable medium of claim 1, wherein the instructions when executed by the mobile device cause the mobile device to:

receive a user credential from the user to verify an identity of the user;

receive a selection of a desired facility via the user interface of the mobile device, wherein the desired facility is a facility that the user would like to have access;

after receiving the user credential and the selection of the desired facility, transmit to an administrator a request for access to the desired facility, wherein the request for access identifies the user and the desired facility; and in response to transmitting the request for access, and when the user is granted access to the desired facility, receive and store at the mobile device a facility access credential that corresponds to the desired facility, wherein when the facility access credential that corresponds to the desired facility is subsequently presented to a secured entry point of the desired facility, the user is granted physical access to the desired facility.

7. The non-transitory computer-readable medium of claim 6, wherein in response to receiving the facility access credential that corresponds to the desired facility, the instructions when executed by the mobile device cause the mobile device to display a notification on the user interface of the mobile device.

8. The non-transitory computer-readable medium of claim 6, wherein when the facility access credential that corresponds to the desired facility is revoked by the administrator, the instructions when executed by the mobile device cause the mobile device to display a notification on the user interface of the mobile device informing the user that the facility access credential that corresponds to the desired facility has been revoked.

9. The non-transitory computer-readable medium of claim 6, wherein in response to receiving the facility access credential that corresponds to the desired facility, the instructions when executed by the mobile device cause the mobile device to add the facility access credential that corresponds to the desired facility to the plurality of facility access credentials that correspond to the plurality of facilities to which the user has requested and currently has access.

10. The non-transitory computer-readable medium of claim 6, wherein the administrator is associated with the desired facility to which access is being requested.

11. A method for issuing facility access credentials to a mobile device of a user for each of multiple facilities, the method comprising:

storing a user profile of the user;

receiving a first user request for access to a first facility;

obtaining a first facility access credential;

associating the obtained first facility access credential with the user profile and the first facility;

transmitting the obtained first facility access credential to the mobile device of the user;

storing the obtained first facility access credential in the mobile device of the user;

receiving a second user request for access to a second facility;

obtaining a second facility access credential;

associating the obtained second facility access credential with the user profile and the second facility;

transmitting the obtained second facility access credential to the mobile device of the user;

storing the obtained second facility access credential in the mobile device of the user;

activating the obtained first facility access credential for use in gaining access to the first facility; and activating the obtained second facility access credential for use in gaining access to the second facility.

12. The method of claim 11, wherein the first user request for access to the first facility and the second user request for access to the second facility are both received from the mobile device of the user.

13. The method of claim 11, wherein the first facility access credential and the second facility access credential are issued by a third-party credential issuer.

14. The method of claim 11, wherein an administrator system separate from the mobile device obtains the first facility access credential, associates the obtained first facility access credential with the user profile and the first facility, and transmits the obtained first facility access credential to the mobile device of the user.

15. The method of claim 14, wherein the administrator system obtains the second facility access credential, associates the obtained second facility access credential with the user profile and the second facility, and transmits the obtained second facility access credential to the mobile device of the user.

16. The method of claim 11, wherein activating the obtained first facility access credential for use in gaining access to the first facility comprises accepting an input via a user interface of the mobile device to manually activate the first facility access credential for use in gaining access to the first facility.

17. The method of claim 11, wherein activating the obtained first facility access credential for use in gaining access to the first facility comprises using a location service of the mobile device to automatically activate the first facility access credential for use in gaining access to the first facility.

18. A method for managing facility access, the method comprising:

electronically receiving a first user request from a user to gain access to a first facility;

electronically receiving user information related to the user;

obtaining a first facility access credential;

linking the obtained first facility access credential with the user information of the user and the first facility;

electronically receiving a second user request from the user to gain access to a second facility;

obtaining a second facility access credential;

linking the obtained second facility access credential with the user information of the user and the second facility;

activating the obtained first facility access credential for use in gaining access to the first facility, resulting in an activated first facility access credential; and activating the obtained second facility access credential for use in gaining access to the second facility, resulting in an activated second facility access credential.

19. The method of claim 18, further comprising:

transmitting a first notification to the user notifying the user of the activated first facility access credential; and transmitting a second notification to the user notifying the user of the activated second facility access credential.

20. The method of claim 18, further comprising:

presenting the activated first facility access credential to a secured entry point of the first facility to grant physical access of the user to the first facility; and presenting the activated second facility access credential to a secured entry point of the second facility to grant physical access of the user to the second facility.

* * * * *